US007621790B2

(12) United States Patent
Torrångs et al.

(10) Patent No.: US 7,621,790 B2
(45) Date of Patent: Nov. 24, 2009

(54) MARINE PROPULSION CONTROL SYSTEM AND A VESSEL CONTAINING SUCH A MARINE PROPULSION CONTROL SYSTEM

(75) Inventors: Peter Torrångs, Mölnlycke (SE); Mathias Lindeborg, Göteborg (SE)

(73) Assignee: CPAC Systems AB, V. Frolunda (SE)

( * ) Notice: Subject to any disclaimer, the term of this patent is extended or adjusted under 35 U.S.C. 154(b) by 0 days.

(21) Appl. No.: 12/279,207

(22) PCT Filed: Mar. 16, 2006

(86) PCT No.: PCT/SE2006/000337

§ 371 (c)(1),
(2), (4) Date: Aug. 13, 2008

(87) PCT Pub. No.: WO2007/105995

PCT Pub. Date: Sep. 20, 2007

(65) Prior Publication Data

US 2008/0318482 A1 Dec. 25, 2008

(51) Int. Cl.
*B63H 5/125* (2006.01)

(52) U.S. Cl. ..... 440/61 S; 440/84

(58) Field of Classification Search ..... 440/1, 440/61 S, 61 A, 87, 84
See application file for complete search history.

(56) References Cited

U.S. PATENT DOCUMENTS 4,739,236 A 4/1988 Burkenpas
4,836,809 A * 6/1989 Pelligrino ..... 440/2
5,004,962 A 4/1991 Fonss et al.
5,222,901 A 6/1993 Burkenpas
6,690,300 B1 2/2004 Gaskins
2004/0209731 A1 10/2004 Graham et al.
2005/0118894 A1 * 6/2005 Kawanishi ..... 440/1

FOREIGN PATENT DOCUMENTS

WO 02099455 A2 12/2002

OTHER PUBLICATIONS

International Search Report for corresponding International Application PCT/SE2006/000337.

* cited by examiner

*Primary Examiner*—Stephen Avila
(74) *Attorney, Agent, or Firm*—WRB-IP LLP

(57) ABSTRACT

A marine propulsion control system for controlling a set of propulsion units carried by a hull of a vessel, said marine propulsion control system including an input command regulator for generating a desired delivered thrust by the propulsion units in the set of propulsion units, a set of control units, wherein each control unit is associated with a separate propulsion unit in said set of propulsion units, wherein each control units is arranged to control the delivered thrust of the associated propulsion unit depending on input control signals received by the control unit and vessel including such a propulsion control unit.

13 Claims, 3 Drawing Sheets

MARINE PROPULSION CONTROL SYSTEM AND A VESSEL CONTAINING SUCH A MARINE PROPULSION CONTROL SYSTEM

BACKGROUND AND SUMMARY

The invention relates to a marine propulsion control system. The invention more specifically relates to a marine propulsion control system adapted to control a set of propulsion units each provided with a control unit for control of the delivered thrust by the propulsion unit and selection of gear in the case a gear unit is associated with the propulsion unit. An input command regulator is provided in the marine propulsion control system to generate inputs from a driver of the vessel. The invention particularly relates to a propulsion control system adapted to control three or more propulsion units with a reduced number of control levers.

Several propulsion control systems adapted to control a plurality of propulsion units with a reduced number of control levers, that is input signals from one control lever should be sufficient to control the delivered thrust in the case the control lever is a throttle lever or to control engagement of gears in the case the control lever is a gear selector of two or more propulsion units. Examples of such propulsion control systems are presented in U.S. Pat. No. 6,872,106 and U.S. Pat. No. 6,751,533.

U.S. Pat. No. 6,872,106 relates to a propulsion control system having a plurality of propulsion units each being controlled by an associated control unit. The associated control unit receives input command signals from control levers via a remote control central processing unit, which central processing unit is configured to receive lever position data from sensors and correlate the lever position data with motor position data in order to directly control more than one motor from a single lever. All the motors controlled by the same input lever will be controlled in identical manner unless some error prevents correct control of the motors.

U.S. Pat. No. 6,751,533 relates to a propulsion control system for a vessel, which in a single embodiment described in relation to FIG. 4 controls a plurality of motors by a single control head. Each throttle lever is connected to a control unit providing control over two motors. All the motors controlled by the same input lever will be controlled in identical manner unless some error prevents. correct control of the motors. The control system according to U.S. Pat. No. 6,751,533 furthermore provides for a synchronisation mode when a master control unit commands a slave control unit to adapt its associated motor or motors to the same percentage of throttle as the motor or motors associated with the master unit. The architecture of the control system is such that there is no difference in configuration between the master control unit and the slave control unit. Each control unit may assume the role of the slave or master depending on the control of the driver. Entry into synchronisation mode is made by setting the control levers of both control units into approximately the same position, where after one of the control units assumes the role of the master control unit and the other assumes the role of the slave unit. In this mode the control lever of the throttle associated with the master control unit controls the throttle of the motor associated with slave control unit such that both motors assumes the same throttle lever. The synchronisation mode does not obviate the need for a control lever for the slave unit since this is a particular mode when the motors should have the same throttle lever. Thus independently of the whether the synchronisation node is assumed or not, all the motors controlled by the same input lever will be controlled in identical manner unless some error prevents correct control of the motors.

It is desirable to provide a marine propulsion control system which enables an adapted control of a plurality of propulsion units controlled by a single input lever such that two propulsion units controlled by the same lever may assume different levels of thrust depending on the driving situation of the vessel.

An aspect of the invention contemplates to arrange least one control unit in a set of control units provided in the control system to act as a slave control unit in all driving conditions and to receive its input control signals from one or several master control units in said set of control units to adapt the delivered thrust of the propulsion unit associated with the slave control unit to the driving condition of the propulsion unit or units associated with the master control unit or units and in that said master control unit or units in all driving conditions receives its input control signals directly from the input command regulator. According to the invention, the slave control unit is always assigned as a slave control unit and is therefore not connected directly to an input command regulator arranged for generating a desired delivered thrust by the propulsion units in the set of propulsion units. The slave control unit therefore receives control information from the master control unit in all driving conditions and adapts the delivered thrust of the propulsion unit associated with the slave control unit to the input signal from the master control unit. The adaptation may be different under different driving conditions as will be explained in further detail below. For this reason, the slave control unit may include a thrust control generator which generates a set value for its associated propulsion unit in dependence of the input signal from the master control unit. The thrust control generator may be in the form of a map or look up table which translates input signal into a requested delivered thrust level for the associated propulsion unit.

In an embodiment of the invention the input command regulator furthermore includes a gear selector for selecting forward, reverse or neutral position of gear units associated with the propulsion units, wherein each control units is furthermore arranged to control the gear selection of the associated gear unit depending on input control signals received by the control unit, wherein the slave control unit or units are, in all driving conditions arranged to adapt the gear selection of the gear unit associated with the slave control unit to the driving condition of the propulsion unit or units associated with the master control unit or units and in that said master control unit or units in all driving conditions receives its input control signals directly from the input command regulator. By the adaptation of the gear selection of the slave control unit, it is for example possible to avoid the vessel to involuntarily increase the drift of the vessel toward one side in the event one propulsion unit does not operate properly. Furthermore docking and slow control of the vessel may be more easily achieved since engagement of forward and rear gears may be programmed to be delayed for propulsion units associated with either the slave or master unit depending on the situation or design of the vessel.

The system is particularly advantageous when the input command regulator includes a single starboard input command regulator and a single port input command regulator and said set of control units includes two master control units including a single starboard master control unit and a single port master control unit and at least one slave control unit. Preferably the slave control unit is associated with a propulsion unit positioned on the centre line of the hull and that said slave control unit receives input control signals from both master control units.

The slave control unit may be arranged to engage the associated gear unit in neutral position unless both master control units has received input command signals requesting to serve their respective gear units to engage either both in reverse or both forward gear, in which case the slave control unit is arranged to engage the associated gear unit in the same gear as both gear units associated with the master units.

In the event both master control units has received input command signals requesting to serve their respective gear units to engage either both in reverse or both forward gear, the slave control unit may be arranged to engage the associated gear unit in the selected gear at a first lower level of delivered thrust and the master control units are arranged to engage their associated gear units in the selected gear at a second higher level of delivered thrust.

In this event the first lower level preferably corresponds to zero thrust and that said second higher level is lower or equal to the number of propulsion units controlled by the slave unit divided by the total number of propulsion units in said set, where the higher level preferably corresponds to less than 10% thrust.

In a further preferred embodiment each slave control unit may be adapted to control the delivered thrust from its associated propulsion unit to an average value of a first and second level of thrust indicated by the starboard and port master control units respectively.

In another embodiment each master control unit is preferably associated at least one slave control unit receiving input control signals solely from the master control unit being associated with propulsion units arranged on the same side of the centre line as the propulsion unit associated with the master control unit.

The slave control units may be arranged such that to each master control unit is associated a slave control unit that receives input control signals from one master control unit only. In this system it is preferred that the level of thrust associated with the slave unit is set to be equal to the level of thrust associated with the master unit.

The invention also relates to a vessel including a propulsion control system as has been described above, which vessel includes three or more propulsion units.

BRIEF DESCRIPTION OF DRAWINGS

An exemplifying embodiment of the invention will be described in greater detail below together with appended drawings where.

DETAILED DISCLOSURE

Figure 1:
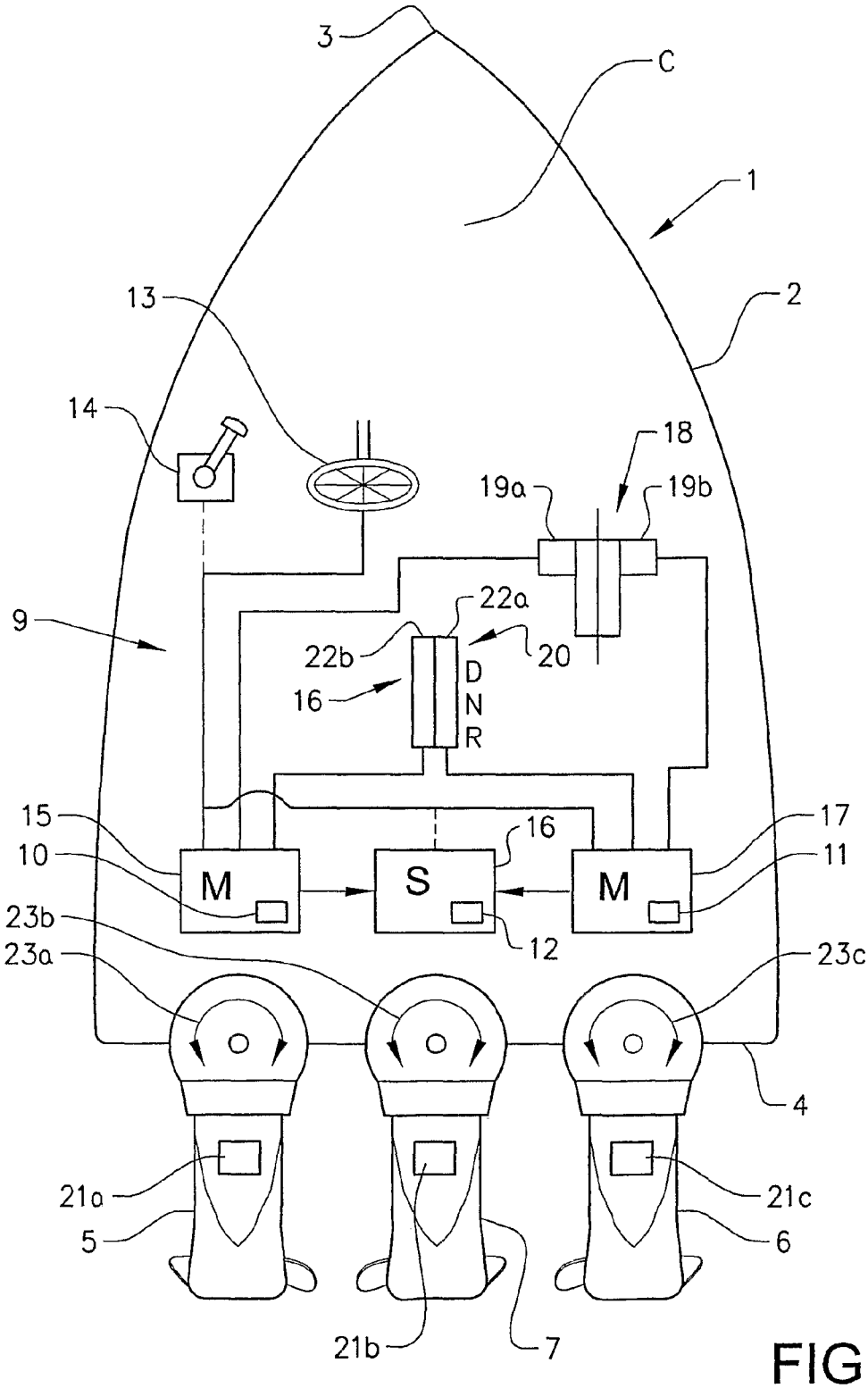
FIG. 1 shows a first embodiment of a marine propulsion control system arranged to control three propulsion units.

FIG. 1 shows a simplified top view of a vessel 1 in which the present invention can be used. Generally, the invention can be used in any type of vessel, such as larger commercial ships, smaller vessel such as leisure boats and other types of water vehicles or vessels. The invention is particularly useful for small leisure boats, but it is nevertheless not limited to such type of water vehicle only.

Figure 2:
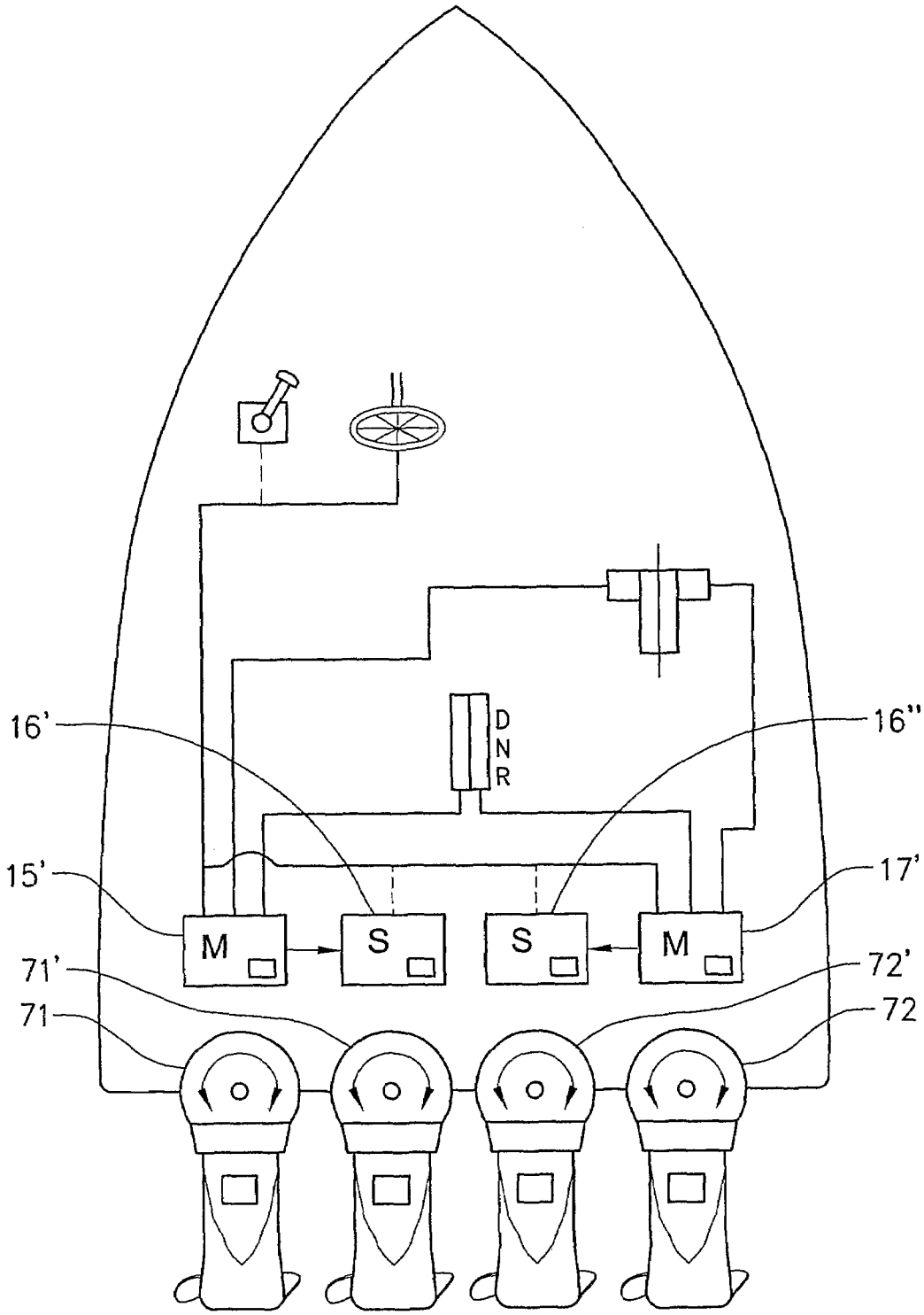
FIG. 2 shows a second embodiment of a marine propulsion control system arranged to control four propulsion units.

As indicated schematically in FIG. 2, the vessel 1 is designed with a hull 2 having a bow 3, a stern 4 and being divided into two symmetrical portions by a centre line C. In the stern 4, three propulsion units 5, 6 and 7 are mounted. More precisely, the vessel 1 is provided with a first propulsion unit 5 arranged at the port side, a second propulsion unit 6 arranged at the starboard side and a third propulsion unit 7 arranged in the centre. The propulsion units 5, 6 and 7 are pivotally arranged in relation to said hull for generating a driving thrust in a desired direction of a generally conventional kind, for example in the form of an outboard drive, an azimuthal drive unit or out board engines. Pivotally arranged propulsion units of different types are known in the art, such as for instance out board engines arranged in the stern of the vessel, out board drive units pivotally arranged in relation to the hull, and which out board drive units are powered from a non rotatably arranged power unit such as for instance of the type described in WO03093105 and azimuthal drive units where the propulsion unit together with its power unit are pivotally arranged in relation to the vessel such as of the type described in U.S. Pat. No. 6,688,927, an will therefore not be described in further detail. The control of the propulsion units are performed by a marine propulsion control system 9.

The two propulsion units 5, 6 may advantageously be independently steerable by a steering control system cooperating with and preferably integrated into the propulsion control system 9. With independently steerable is intended that each propulsion unit is connected to and controllable by means of separate steering control units 10, 11 and 12 which are suitably in the form of a computerized unit for receiving commands from steering control instruments 13, 14. The steering control instruments may be provided in the form of a steering wheel 13 or a joy stick 14 or the combination of both.

The invention also applies to propulsion units that are locked in a fixed direction used on vessels steered by rudders in stead of pivotally arranged propulsion units.

The separate steering control units 10-12 may be integrated in a set of control units 15-17 included in the propulsion control system 9, where each control unit 15-17 is associated with a separate propulsion unit 5-7 in the set of propulsion units provided on the vessel. Each control units 15-17 in the set of control units is arranged to control the delivered thrust of the associated propulsion unit depending on input control signals received by the control unit.

An input command regulator 18 includes means for generating a desired delivered thrust by the propulsion units in the set of propulsion units is arranged in the marine propulsion control system. The input command regulator may for this purpose include a port throttle lever 19*a*, and a starboard throttle lever 19*b* arranged to generate a desired delivered thrust by the propulsion units contributing to the thrust on the starboard and port side respectively. Each levers generates input control signals to an assigned master control unit 15, 17 respectively while the centre control unit 16 acts as a slave unit and receives its input control signals from both master control units 15, 17.

The master control units 15, 17 furthermore receives input signal from a gear selector 20 arranged in the input command regulator 18 which gear selector 20 serves to control respective gear unit 21*a*-21*c* associated with the propulsion units to be engaged in reverse, neutral or drive. Preferably two gear selectors 22*a*, 22*b* are provided. One for each group of propulsion units positioned on the starboard side of the centre line and one for the group of propulsion units positioned on the port side of the centre line.

Such gear selector and throttle lever units are previously known as such, and for this reason they are not described in detail here. Based on received information from the steering control instruments 13, 14, the control units 15-17 are arranged to control the propulsion units 5-7 in a suitable manner to propel the vessel 1 with a requested direction and thrust.

Preferably the input command regulator 18 includes a single starboard input command regulator and a single port input command regulator for each function that is under control by the input command regulator. As have been explained above, these functions may include port and starboard throttle levers and port and starboard gear selectors. and said set of control units includes two master control units including a single starboard master control unit and a single port master control unit and at least one slave control unit.

The position of the propulsion units 5, 6 and 7 may be individually controllable such that they may pivot and assume intended directions for generating a thrust in a desired direction independently of each other. Respective control unit controls actuator means 13, 14, which may for instance be constituted by a stepping motor or a hydraulic circuit. The steering control units 10,11, 12 contains means for mapping an input signal from the steering control instruments into a reference value angle for respective propulsion unit 5, 6, 7 where the actuator means 23*a*-23*c* are arranged to move the propulsion units such that they assumes the reference value angle. The mapping may be of simple type such that a steering angle is obtained from the steering control instruments and that the actuator means uses this input signal as the reference value angle. The mapping may also be more complex such that the reference value angles are calculated in dependence of the driving situation including speed, desired trim angle, whether docking is performed such that crabbing (movement in the sideways direction) of the vessel is desired and so forth.

As has been explained above the master control units 15, 17 receives input signals directly from the input command regulator 18, while the slave control unit 16 receives input command signals from, in this case both master control units 15, 17. This applies in particular to the control of gear selection and applied thrust by the propulsion units, while the steering control may be directly applied to the steering control unit 12 arranged in the slave control unit 16.

FIG. 2 shows a similar system as I FIG. 1, with the difference that the vessel includes four propulsion units which are controlled by master and slave control units each controlling an assigned propulsion unit. Here the slave control unit only receives input signals from one of the master control units. That is the slave control unit 16' controls a first port side propulsion unit P1 by using information provided from a port side master control unit 15'.

Furthermore, the slave control unit 16" controls a first starboard side propulsion unit P2 by using information provided from a starboard side master control unit 17'.

Figure 3:
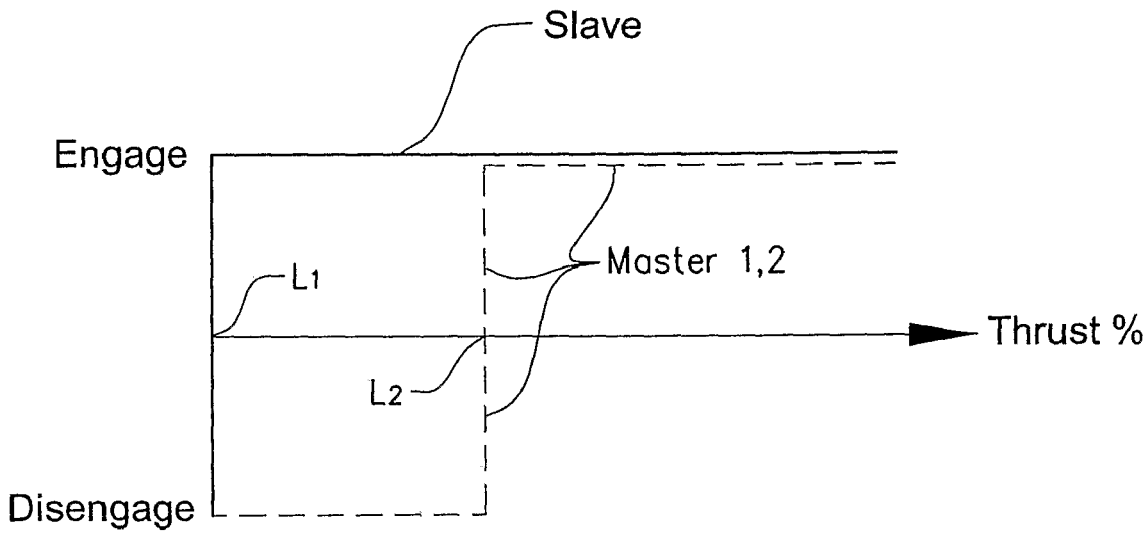
FIG. 3 shows a graphic representation of a scheme for engagement and disengagement of gears in gear units.

FIG. 3 shows a graphic representation of a scheme for engagement and disengagement of gears in gear units controlled by two master control units and a slave control unit. In the event both master control units 15,17 has received input command signals requesting to serve their respective gear units 21*a*,21*c* to engage either both in reverse or both forward gear, the slave control unit 16 is arranged to engage the associated gear unit 21 *b* in the selected gear at a first lower level L1 of delivered thrust and the master control units 15,17 are arranged to engage their associated gear units 21*a*, 21*c* in the selected gear at a second higher level L2 of delivered thrust. In a preferred embodiment the first lower level L1 corresponds to zero thrust and the second higher level L2 is lower or equal to a proportion of the maximum of requested thrust equal to the number of propulsion units controlled by the slave unit divided by the total number of propulsion units in said set, that is L2=number of propulsion units controlled by the slave control unit/total number of propulsion units.

In a preferred embodiment of the invention where the slave control unit 16 controls a propulsion unit positioned in the centre is dependent on information from a port master control unit 15 and a starboard master control unit 17, the slave control unit 16 is adapted to control the delivered thrust Tslave from its associated propulsion unit 7 to an average value of a first and second level of thrust TMaster1, TMasters indicated by the port and starboard master control units 15, 17 respectively.

The invention claimed is:

1. A marine propulsion control system for controlling a set of propulsion units carried by a hull of a vessel, the marine propulsion control system including an input command regulator for generating a desired delivered thrust by the propulsion units in the set of propulsion units, a set of control units, wherein each control unit is associated with a separate propulsion unit in the set of propulsion units, wherein each control unit is arranged to control delivered thrust of the associated propulsion unit depending on input control signals received by the control unit, wherein at least one control unit in the set of control units is arranged to act as a slave control unit in all driving conditions and to receive its input control signals from one or several master control units in the set of control units to adapt the delivered thrust of the propulsion unit associated with the slave control unit to a driving condition of the propulsion unit or units associated with the master control unit or units and the master control unit or units in all driving conditions receives its input control signals directly from the input command regulator, wherein the input command regulator includes a single starboard input command regulator and a single port input command regulator for each function that is under control by the input command regulator and the set of control units includes two master control units including a single starboard master control unit and a single port master control unit and at least one slave control unit.

2. A marine propulsion control system according to claim 1, wherein the input command regulator includes a gear selector for selecting forward, reverse or neutral position of gear units associated with the propulsion units, wherein each control unit is furthermore arranged to control gear selection of the associated gear units depending on input control signals received by the control unit, wherein the slave control unit or units are, in all driving conditions, arranged to adapt the gear selection of the gear unit associated with the slave control unit to the driving condition of the propulsion unit or units associated with the master control unit or units and the master control unit or units in all driving conditions receives its input control signals directly from the input command regulator.

3. A marine propulsion control system according to claim 1, wherein the slave control unit is associated with a propulsion unit positioned on the center line of the hull and the slave control unit receives input control signals from both master control units.

4. A marine propulsion control system according to claim 3, wherein the slave control unit is arranged to engage the associated gear unit in neutral position unless both master control units has received input command signals requesting to serve their respective gear units to engage either both in reverse or both forward gear, in which case the slave control unit is arranged to engage the associated gear unit in the same gear as both gear units associated with the master units.

5. A marine propulsion control system according to claim 4, wherein, in the event both master control units has received input command signals requesting to serve their respective gear units to engage either both in reverse or both forward gear, the slave control unit is arranged to engage the associated gear unit in the selected gear at a first lower level of delivered thrust and the master control units are arranged to engage their associated gear units in the selected gear at a second higher level of delivered thrust.

6. A marine propulsion control system according to claim 5, wherein the first lower level corresponds to zero thrust and that the second higher level is lower or equal to a proportion of the maximum of requested thrust, the proportion being equal to the number of propulsion units controlled by the slave control unit divided by the total number of propulsion units in the set.

7. A marine propulsion control system according to claim 6, wherein the higher level corresponds to less than 10% thrust.

8. A marine propulsion control system according to claim 1, wherein each slave control unit is adapted to control the delivered thrust from its associated propulsion unit to an average value of a first and second level of thrust indicated by the starboard and port master control units respectively.

9. A marine propulsion control system according to claim 1, wherein to each master control unit is associated at least one slave control unit receiving input control signals solely from the master control unit being associated with propulsion units arranged on the same side of the centre line as the propulsion unit associated with the slave control unit.

10. A marine propulsion control system according to claim 1, wherein to each master control unit is associated a slave control unit that receives input control signals from one master control unit only.

11. A marine propulsion control system according to claim 10, wherein the level of thrust associated with the slave control unit is set to be equal to the level of thrust associated with the master control unit.

12. A vessel comprising a marine propulsion control unit according to claim 1 and a propulsion unit controlled by each control unit in the set of control units.

13. A vessel according to claim 12, wherein the vessel is provided with three or more propulsion units.

* * * * *